US012473815B2

(12) United States Patent
Chen

(10) Patent No.: US 12,473,815 B2
(45) Date of Patent: Nov. 18, 2025

(54) REDUCTION OF BACKWARD WHIRL DURING DRILLING

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 713 days.

(21) Appl. No.: 17/309,300

(22) PCT Filed: Dec. 27, 2018

(86) PCT No.: PCT/US2018/067657

§ 371 (c)(1),
(2) Date: May 17, 2021

(87) PCT Pub. No.: WO2020/139341

PCT Pub. Date: Jul. 2, 2020

(65) Prior Publication Data

US 2022/0025755 A1 Jan. 27, 2022

(51) Int. Cl.
*E21B 44/02* (2006.01)
*E21B 45/00* (2006.01)

(52) U.S. Cl.
CPC ..... *E21B 44/02* (2013.01); *E21B 45/00* (2013.01)

(58) Field of Classification Search
CPC ..... E21B 44/02; E21B 44/00; E21B 45/00; E21B 10/46; E21B 2200/20
See application file for complete search history.

(56) References Cited

U.S. PATENT DOCUMENTS 5,010,789 A * 4/1991 Brett ..... G01M 1/32 700/29
5,456,141 A 10/1995 Ho
(Continued)

FOREIGN PATENT DOCUMENTS

CA 2883247 A1 * 3/2014 ..... E21B 10/42
CA 2883522 A1 * 3/2014 ..... E21B 10/00
(Continued)

OTHER PUBLICATIONS

Macpherson, John D., and et al. "A framework for transparency in drilling mechanics and dynamics measurements." In SPE Annual Technical Conference and Exhibition?, p. D031S042R002. SPE, 2015 (Year: 2015).*
(Continued)

*Primary Examiner* — Douglas Kay
(74) *Attorney, Agent, or Firm* — DeLizio, Peacock, Lewin & Guerra LLP

(57) ABSTRACT

An apparatus includes a processor and a machine-readable medium having program code executable by the processor to cause the apparatus to determine a first parameter based on a walk force of a drill bit. The program code also includes instructions to generate a whirl index value that comprises a ratio of drilling parameters, wherein at least one parameter of the ratio of drilling parameters is the first parameter. Based on a determination that the whirl index value exceeds a whirl index threshold, the program code includes instructions to determine that a drilling operation induces backward whirl, wherein the drilling operation is characterized by the drilling parameters.

17 Claims, 11 Drawing Sheets

(56) References Cited

U.S. PATENT DOCUMENTS

| | | | | |
|---|---|---|---|---|
| 5,864,058 | A | 1/1999 | Chen | |
| 5,937,958 | A | 8/1999 | Mensa-Wilmot et al. | |
| 7,457,734 | B2 | 11/2008 | Johnson et al. | |
| 10,296,678 | B2 * | 5/2019 | Spencer | G06F 30/20 |
| 2004/0254664 | A1 * | 12/2004 | Centala | E21B 10/00 703/7 |
| 2007/0005316 | A1 * | 1/2007 | Paez | E21B 10/46 703/10 |
| 2011/0214878 | A1 * | 9/2011 | Bailey | E21B 7/00 175/57 |
| 2013/0245950 | A1 | 9/2013 | Jain et al. | |
| 2014/0136168 | A1 * | 5/2014 | Spencer | G06F 30/20 703/2 |
| 2017/0058658 | A1 * | 3/2017 | Spencer | E21B 7/04 |
| 2017/0107808 | A1 * | 4/2017 | Forstner | E21B 44/00 |
| 2020/0095859 | A1 | 3/2020 | Chen | |
| 2020/0149386 | A1 * | 5/2020 | Menand | E21B 47/022 |

FOREIGN PATENT DOCUMENTS

| | | | | |
|---|---|---|---|---|
| WO | 2016032441 | A1 | 3/2016 | |
| WO | WO-2018152636 | A1 * | 8/2018 | E21B 21/08 |

OTHER PUBLICATIONS

Menand, Stephane, Hedi Sellami, and C. Simon. "PDC bit classification according to steerability." SPE Drilling & Completion 19, No. 01 (2004): 5-12 (Year: 2004).*

PCT Application Serial No. PCT/US2018/067657, International Search Report, mailed Sep. 25, 2019, 3 pages.

PCT Application Serial No. PCT/US2018/067657, International Written Opinion, mailed Sep. 25, 2019, 5 pages.

Brett, et al., "Bit Whirl—a New Theory of PDC Bit Failure", Society of Petroleum Engineers Drilling Engineering, SPE-19571-MS, SPE Annual Technical Conference and Exhibition, San Antonio, Texas, Oct. 8, 1989, pp. 275-281.

Johnson, "A New Method of Producing Laterally Stable PDC Drill Bits", Society of Petroleum Engineers Drilling & Completion, vol. 23, Issue 3, SPE-98986-PA, Sep. 2008, pp. 314-324.

Warren, et al., "Development of a Whirl-Resistant Bit", Society of Petroleum Engineers Drilling & Completion, SPE-19572-PA, vol. 5, Issue 04, Dec. 1990, pp. 267-274.

* cited by examiner

REDUCTION OF BACKWARD WHIRL DURING DRILLING

BACKGROUND

The disclosure generally relates to the field of drilling, and more particularly to increasing accuracy during drilling.

Various applications in exploration, resource acquisition, construction, and storage may require the drilling of boreholes into a volume of solid material, such as rock or ice in the subsurface of the Earth. A common method of generating and lengthening these holes is to extend an arm with a drill bit into the hole and mill away the solid material using the drill bit. Once generated in an appropriate region, these holes provide access to previously inaccessible resources, such as hydrocarbons, water, or minerals.

Producing a hole using a rotating drill bit at the end of an extended arm can result in a phenomenon known as backward whirl. During backward whirl, the entire drill bit and the end of the arm to which it is attached will move in an eccentric motion around the borehole in a direction counter to the drill bit rotational direction. This counter-rotation decreases the operational effectiveness of the drill bit, makes hole size estimation more inaccurate, decreases the useful lifespan of the drill bit, and can cause catastrophic failures in the form lateral/bending vibrations in the extended arm.

BRIEF DESCRIPTION OF THE DRAWINGS

Embodiments of the disclosure may be better understood by referencing the accompanying drawings.

DESCRIPTION

Figure 1:
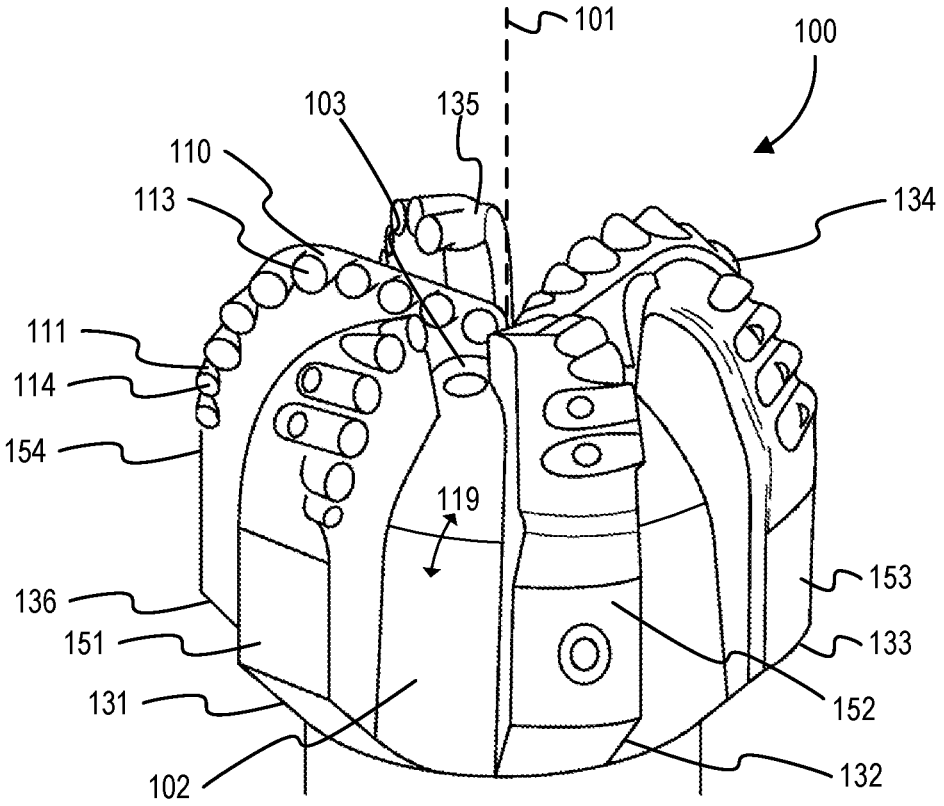
FIG. 1 is an isometric view of a drill bit.

The description that follows includes example systems, methods, techniques, and program flows that embody embodiments of the disclosure. However, it is understood that this disclosure can be practiced without these specific details. For instance, this disclosure refers to forces on bit cutters in illustrative examples. Aspects of this disclosure can be instead applied to other forces such as forces on gage pads, pipes, blades, etc. In other instances, well-known instruction instances, protocols, structures and techniques have not been shown in detail in order not to obfuscate the description.

Various embodiments may relate to systems and methods that include the determination of a whirl index value to determine conditions that can induce backward whirl. During backward whirl in a borehole, a reactive force acting on the drill bit, in addition to rotation, such as the friction force between the drill bit and the borehole wall or the friction force between a bottomhole assembly (BHA) and the borehole wall moves the drill bit in an eccentric motion. Quantifying this effect with sufficient operational accuracy in a real-time drilling environment using conventional mechanical analytical methods can be difficult due to the number of variables required to accurately simulate the motion of the drilling components and the uncertainty in the parameters used for the conventional mechanical analytical methods.

A system can overcome these limitations by determining a whirl index value using a ratio of a first parameter and a second parameter, wherein the first parameter is based on a walk force of the drill bit while it is rotating in a bit rotation direction. The walk force of the drill bit is a force perpendicular to bit lateral motion and can be applied to the drill bit directly. For example, the walk force can be applied to the cutters of the drill bit directly. Alternatively, or in addition, the walk force can be indirectly applied to the drill bit via a component attached to the drill bit. For example, the walk force can be applied to a pipe attached to the drill bit, which can then transfer the walk force to the drill bit. The first parameter can include a ratio that comprises the walk force. For example, the first parameter can be a ratio that includes the total walk force on a drill bit. Alternatively, or in addition, the first parameter can includes a derivative based on the walk force. For example, the derivative based on the walk force can be a derivative of the walk force with respect to a rate of lateral penetration (ROL) of the drill bit. The second parameter can be based on a weight on bit (WOB) value of the drill bit, wherein the WOB is the force experienced by the drill bit in the axial direction of the drill bit. In addition, the whirl index value can also be based on one or more bit design parameters of the drill bit, such as a back rake angle, side rake angle, bit radius, bit axial location, bit cone angle, etc.

The system can compare the whirl index value with a whirl index threshold to determine if the whirl index value satisfies or exceeds the whirl index threshold. In cases where the whirl index value exceeds the whirl index threshold, the system can determine that a drilling operation using the drill bit, and operating under drilling conditions characterized by the parameters, is experiencing backward whirl, or is at a significant risk of experiencing backward whirl. The whirl index threshold can be a quantitative value selected as a predetermined initial value. For example, the whirl index threshold can be selected as a percentage of a force-based parameter such as 50%, 60%, 100%, etc. The whirl index threshold for a type of drill bit may be determined from field tests and/or laboratory tests.

In response to the determination that the whirl index value exceeds the whirl index threshold, the system can then display an alert indicating that the threshold is exceeded, modify a bit design parameter to decrease the whirl index during a bit design process, and/or modify a drilling parameter to decrease the whirl index value during a drilling operation. In some embodiments, decreasing the whirl index value during a drilling operation can include using program code to reduce a rate of lateral penetration (ROL) of a drill bit attached to a drill string. In addition, or alternatively, the system can use the results to generate a bit stability map specific to the drill bit or type of drill bit, wherein the bit stability map associates sets of drilling parameters to an indicator of whether the drilling parameters would induce backward whirl (i.e. the map can indicate whether operating at a particular set of drill parameters using the drill bit will risk inducing backward whirl by exceeding the whirl index threshold).

The operations described above can increase the speed and accuracy of detecting when a drilling operation is at risk of experiencing backward whirl. By increase the speed and accuracy of making this determination, the operations can reduce the prevalence of backward whirl by optimizing drill bit design or selection and providing real-time feedback on when to change drilling operations to decrease backward whirl. By decreasing backward whirl during a drilling operation, the operations described above can increase drilling efficiency and decrease the possibility of equipment damage via backward whirl.

Example Drill Bits

FIG. 1 is an isometric view of a drill bit. In FIG. 1, the drill bit 100 is adapted for drilling through formations of rock to generate a borehole. Drill bit 100 includes a bit axis 101 and a bit face 103 formed on the end of the drill bit 100 that supports cutting structures attached to drilling pads. The drill bit 100 can be created using various methods, such as using powdered metal tungsten carbide particles in a binder material to form a hard metal cast matrix, machining the drill bit from a metal block such as steel, using an additive manufacturing device such as a three-dimensional printer, etc. As shown in this example, the drill bit 100 includes six angularly spaced-apart blades 131-136, which are integrally formed as part of, and which extend from, a bit body 102. The blades 131-136 extend radially across the bit face 103 and longitudinally along a portion of the periphery of the drill bit 100. It should be understood that as used herein, the term "radial" or "radially" refers to positions or movement substantially perpendicular to the bit axis 101. In addition, it should be understood that as used herein, the term "axial," "axially", or "longitudinally" refers to positions or movement generally parallel to bit axis 101.

The blades 131-136 include blade profiles on which bit cutters such as the bit cutter 110 and the bit cutter 111 of the drill bit 100 are mounted. The blades 131-136 are separated by grooves which define drilling fluid flow paths 119 between and along the cutting faces of the bit cutters, such as the cutting face 113 of the bit cutter 110. Drill bit 100 further includes gage pads 151-154, which can be angularly spaced about the circumference of drill bit 100. Gage pads (only the gage pads 151-154 are shown) intersect and extend from each of the blades 131-136, respectively. The gage pads 151-154 can help maintain the size of the borehole by a rubbing action, particularly when bit cutters such as the bit cutter 110 on the bit face 103 wear slightly under gage. For example, the rubbing action of the gauge pads 151-154 can help maintain the size of the borehole to a full gage diameter. In addition, the gage pads 151-154 also help stabilize drill bit 100 against vibration and include forward-facing cutters or inserts. As used herein, "forward-facing" is used to describe the orientation of a surface that is substantially perpendicular to the cutting direction of drill bit 100. To maintain the size of the borehole more effectively, bit cutters such as the bit cutter 111 can be included, wherein the bit face 114 of the bit cutter 111 is positioned further radially away from the bit axis 101 than the cutting face 113 of the bit cutter 110.

Figure 2:
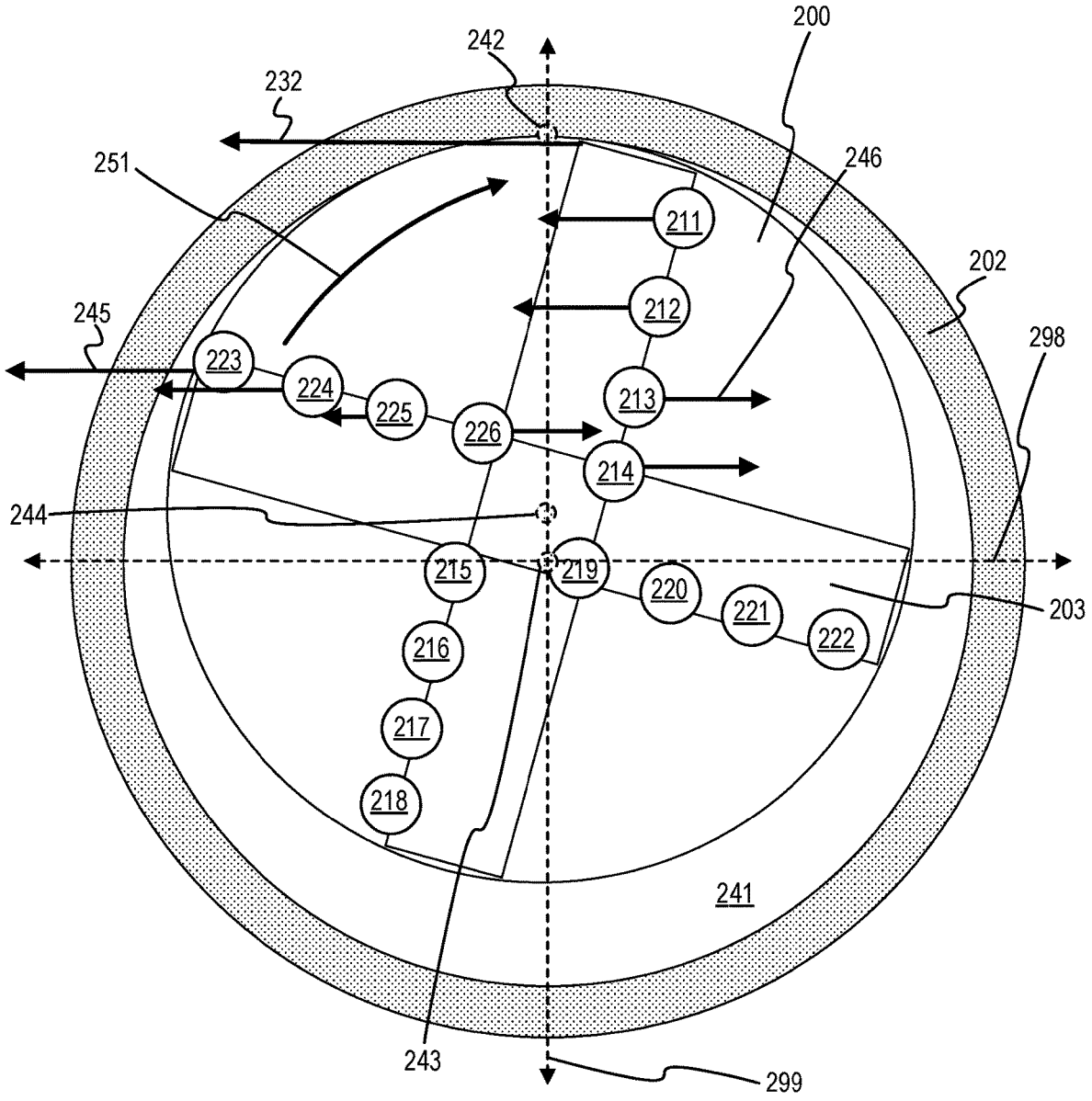
FIG. 2 is a bottom view of a simplified schematic of a drill bit experiencing backward whirl in a borehole.

FIG. 2 is a bottom view of a simplified schematic of a drill bit experiencing backward whirl in a borehole. In FIG. 2, a drill bit 200 is inside of the borehole 241 and is surrounded by the solid material 202. The drill bit 200 may be similar to the drill bit 100 of FIG. 1. In some embodiments, the solid material 202 can represent materials found in the Earth's subsurface such as coal, rock formations, ice, etc. The drill bit 200 include multiple bit cutters at the bit cutter positions 211-226 fixed to a set of blades 203. The drill bit 200 rotates in a clockwise direction represented by the clockwise arrow 251, during which one or more of the bit cutters at the bit cutter positions 211-226 can be cutting or in contact with the solid material 202.

During the clockwise motion of the drill bit 200, the drill bit 200 can experience a sidewall force that can change to any radial direction in a random or periodic pattern. The sidewall force can induce an eccentricity in the position of the drill bit 200 relative to the borehole center 243 of the borehole 241. For example, the sidewall force can result in the eccentricity shown in FIG. 2, wherein the drill bit center 244 is displaced from the borehole center 243 in a direction parallel to the vertical axis 299, rendering the line segment between the drill bit center 244 and a point 242 as also parallel to the vertical axis 299, wherein the point 242 is a point of contact between the drill bit 200 and a wall of the borehole 241. At a different moment in time, the drill bit center 244 can be displaced from the borehole center 243 in a direction parallel to the horizontal axis 298. The contact between the rotating drill bit 200 and the wall of the borehole 241 results in a friction force or a drag force in the horizontal direction shown by the arrow 232, which opposes the clockwise direction of the drill bit 200 and can be classified as a type of bit walk force.

In addition to the friction forces described above, each of the bit cutters at the bit cutter positions 211-226 in contact with the solid material 202 can also experience a friction force or drag force during drilling operations that can also be classified as a type of bit walk force, wherein none, some, or all of the bit cutters can be in contact with the solid material 202. For example, cutting action between the solid material 202 and the cutter at the bit cutter position 223 result in a walk force applied to the bit cutter position 223 in a direction perpendicular to the vertical axis 299 and represented by the arrow 245. The cutter walk forces of a drill bit can have their own magnitudes and be in different directions, wherein walk force directions can be perpendicular to the line between a bit center and a hole center. For example, cutting action between the solid material 202 and the cutter at the bit cutter position 213 can result in a second walk force in a direction 246, wherein the direction 246 is opposes the arrow 245. While the walk forces depicted in FIG. 2 are shown to perpendicular to the vertical axis 299, other walk forces can be in different directions. As will be described further below, a sum of the walk forces experienced by the drill bit 200, the bit cutters at the bit cutter positions 211-226, and other components attached to the drill bit 200, can be used to determine a total bit walk force.

Example Flowcharts

Figure 3:
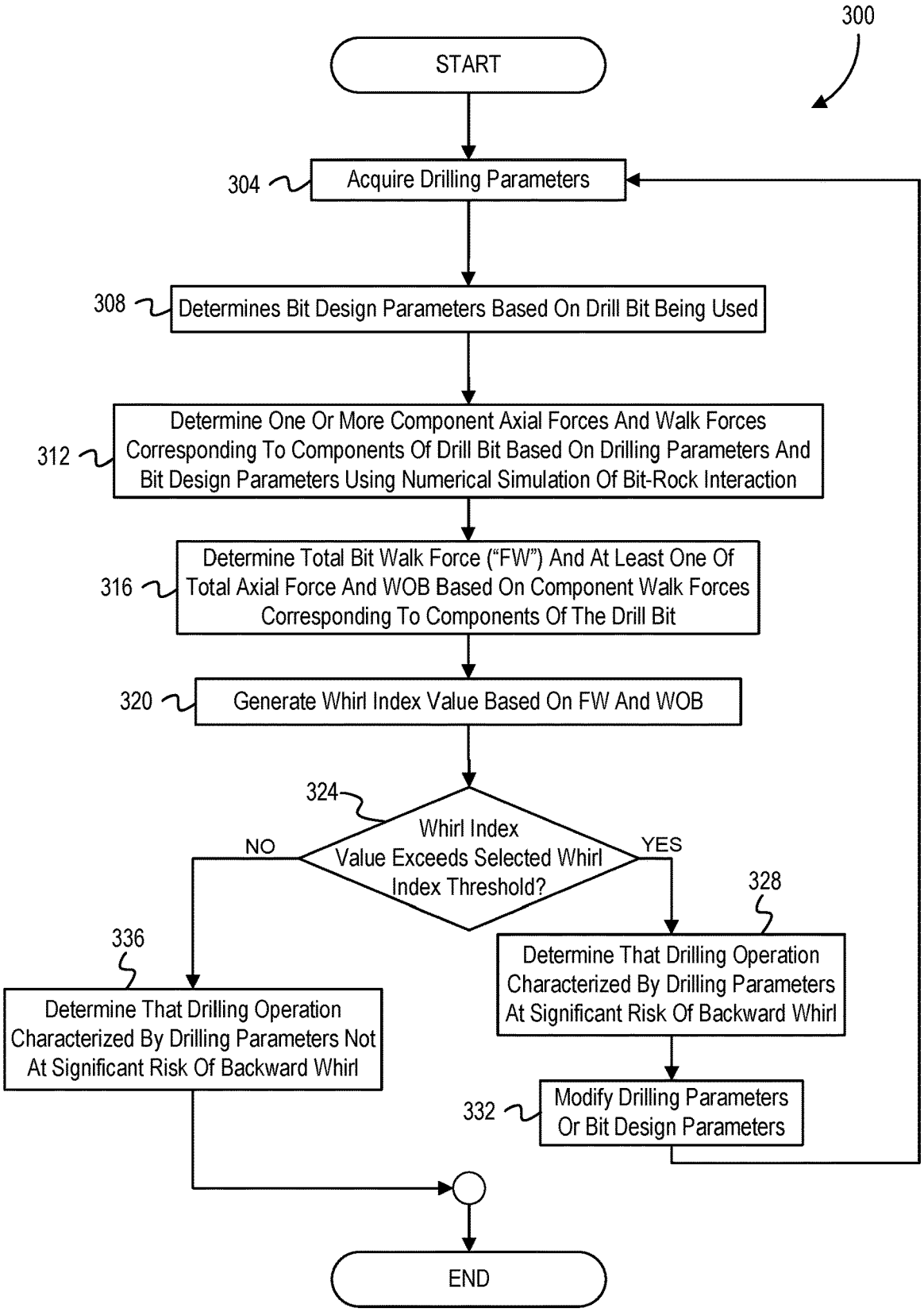
FIG. 3 is a flowchart of operations to determine a whirl index based on drilling parameters and bit design variables.

FIG. 3 is a flowchart of operations to determine a whirl index based on drilling parameters and bit design variables. FIG. 3 depicts a flowchart 300 of operations to determine a backward whirl index value using a system that includes a processor, wherein the system can be similar to or identical to computer system 1098 or computer device 1100 shown in FIGS. 10 and 11, respectively. The flowchart 300 includes operations that can be executed by the processor to determine a backward whirl index value for a drill bit operating under a selected set of drilling parameters. With reference to FIGS. 1-2, the operations of the flowchart 300 can be used to determine the backward whirl index for the drill bit 100 or the drill bit 200. Operations of the flowchart 300 start at block 304.

At block 304, the system acquires drilling parameters. The drilling parameters can include a bit rotation speed in units such as rotations per minute, rate of penetration (ROP), rate of lateral penetration (ROL), material properties of the material being drilled, among others. In some embodiments, one or more of the drilling parameters can be acquired from controllable drilling parameters in real-time. For example, a target ROP can be set as the ROP for an automated drilling device, and this target ROP can be reported to the system as a drilling parameter, allowing the system to acquire the ROP. Alternatively, or in addition, one or more drilling parameters can be derived from calculation of other known drilling parameters. For example, ROL can be calculated from displacement measurements provided by displacement sensors attached to the drill bit 100 and dividing by the corresponding time differences between the displacement measurements. Furthermore, one or more drilling parameters can be acquired from a database of known values. For example, material properties such as elastic modulus and critical fracture stress can be acquired from a database of known values.

At block 308, the system determines bit design parameters based on the drill bit being used. The bit design parameters can include bit size, bit profile parameters, the number of blades on the drill bit, the number of cutters on each blade, the size(s) of the cutters, the distribution of the cutters, the cutter back rake angle(s) and distribution, the cutter side rake distribution, the non-cutting element distribution of the drill bit, the gage pad length, among others. The system can acquire the bit design parameters from a database of known values. Alternatively, or in addition, the system can acquire the bit design parameters from user input through a user interface system.

At block 312, the system determines one or more component axial force and walk forces corresponding to each of the components of the drill bit based on the drilling parameters and the bit design parameters using a numerical simulation of bit-rock interaction. Example drilling parameters can include a ROP, a ROL, a bit rotational speed and a rock strength. A bit-rock simulator which is able to consider both bit lateral motion and axial motion may be used to calculate the axial force and walk force of each cutting element and non-cutting element.

At block 316, the system determines a total bit walk force ("FW") and at least one of a total axial force and a WOB based on the component walk forces and/or axial forces corresponding to each of the components of the drill bit. In some embodiments, the system determines a ROP, a ROL and a walk force for a given rotation speed, a WOB and a lateral bit force. The rotation speed, WOB, and/or lateral bit force can be determined from known drilling parameters, sensor measurements, calculations, or the simulation described above at block 312. The total walk force FW can be determined using Equations 1, wherein $FW_i$ is the walk force of the individual component i:

$$FW=\Sigma_{i=1}^{n}FW_i \tag{1}$$

At block 320, the system generates a whirl index value based on the FW and the WOB. The system can generate the whirl index value based on the FW by using the FW directly or by using a derivative of FW. For example, the system can generate the whirl index value using Equation 2 below, where $WI_t$ is a derivative version of the whirl index value, $$\frac{dFW}{dROL}$$

is a first value representing the derivative of the total walk force (FW) to the drill bit's rate of lateral penetration, and $$\frac{dWOB}{dROP}$$

is a second value representing the derivative of the WOB to the drill bit's ROP:

$$WI_1 = \frac{\left(\frac{dFW}{dROL}\right)}{\left(\frac{dWOB}{dROP}\right)} \tag{2}$$

The derivative version of the whirl index value, $WI_1$, may be used to represent a bit's average whirl index for a given range of ROP and a given range of ROL. It can be used in bit design process to ensure the absolute value of the average whirl index for a type of bit is smaller than the whirl index threshold for the same type of bit.

The derivatives in Equation 2 can be determined based on a set of measurements of the FW, ROL, WOB, and ROP using various derivative determination methods. Derivative determination methods include setting the derivative value as a ratio of differences at a target point determined by drilling parameters, taking an average of the ratio of differences around the target point, fitting a curve to the data and determining the derivative of the fitted curve, among others. For example, the system can use Equation 3 to determine the derivative at the i-th point in the ROL value, wherein the i-th point is the ROL as determined at block 304 above:

$$\left(\frac{dFW}{dROL}\right)_i = \frac{FW_{i+1} - FW_{i-1}}{ROL_{i+1} - ROL_{i-1}} \tag{3}$$

In some embodiments, the system can use an approximated index value as the whirl index value. The system can use the approximated index value when the number of measurement values within an acceptable range of a target ROL or ROP would result in an uncertainty for the derivative that is greater than a selected derivative uncertainty threshold. Furthermore, the use of an approximated index value to determine the whirl index value can result in a faster calculation for the whirl index value compared to the calculation of the whirl index value using Equation 2 above. To determine the approximated index value, instead of taking a derivative value based on FW, the system can directly use FW as shown in Equation 4 below, wherein $WI_2$ is the approximated index value:

$$WI_2 = \frac{FW/ROL}{WOB/ROP} \tag{4}$$

$WI_2$ can be calculated for each set of drilling parameters and can be used to calculate a stability map as described below in FIG. 4.

At block 324, a determination is made as to whether the whirl index value exceeds a selected whirl index threshold. In some embodiments, the whirl index threshold can be equal to or based on a value stored in a database of known values, wherein the whirl index threshold is associated with a type of bit designs corresponding with the drill bit 100. For example, the system can determine that the drill bit has a first bit design, look up a whirl index threshold associated with the first bit design in a database, and determine that the whirl index threshold is 50%. The system can then determine that the whirl index value exceeds the whirl index threshold if the absolute value of the whirl index value is greater than the absolute value of the whirl index threshold. Alternatively, the system can determine that the whirl index value exceeds the whirl index threshold if the absolute value of the whirl index value is greater than or equal to the absolute value of the whirl index threshold. In some embodiments, where the whirl index value is redefined to be a ratio having a numerator based on ROL and a denominator based on FW, the system can determine that the whirl index value exceeds the whirl index threshold when the whirl index value is less than the whirl index threshold. For example, if the inverse of $WI_1$ shown in Equation 2 is used as a whirl index value, then the whirl index value exceeds the whirl index threshold when the inverse of $WI_1$ is less than the whirl index threshold. If the whirl index value exceeds a whirl index threshold, then operations of the flowchart 300 continue at block 328. Otherwise, operations of the flowchart 300 continue at block 336.

At block 328, the system determines that drilling operations characterized by the drilling parameters are at risk of experiencing backward whirl, because the whirl index has been exceeded. Determining that the drilling operations are at risk of experiencing backward whirl can include setting a boolean or other indicator variable to indicate that the drilling operations are at risk of experiencing backward whirl. In addition, the system can display a graphical warning in a display screen to indicate that the drilling operations are at risk of experiencing backward whirl and suggest drilling parameter changes.

At block 332, the system can modify the drilling parameters or bit design parameters. In cases where the operations described above are performed simultaneously with a drilling operation, the system can modify the drilling parameters directly and influence the drilling operation. For example, after determining that the whirl index value exceeds the whirl index threshold described above for block 324, the system can change the rotation speed and reduce the ROP of the drilling operation. Alternatively, if the operations described above are performed during a drill bit design operation or drill bit selection operation, the system can modify the bit design parameters to reduce the whirl index value. For example, after determining that the whirl index value exceeds the whirl index threshold described above for block 324 if a first drill bit is selected, the system can select a second drill bit having a reduced whirl index value. After modifying the drilling parameters or the bit design parameters, the system can then return to block 304.

At block 336, the system determines that drilling operations characterized by the drilling parameters have not exceeded a selected risk value to experience backward whirl. In cases the whirl index value does not exceed the whirl index threshold, the system can determine that the drilling parameters would not be at risk of inducing backward whirl. In some embodiments, the system can then end the operations of the flowchart 300 until at least one of the drilling parameters changes. Alternative systems can instead modify the drilling parameters to increase drilling efficiency, such as by increasing ROP or WOB.

Figure 4:
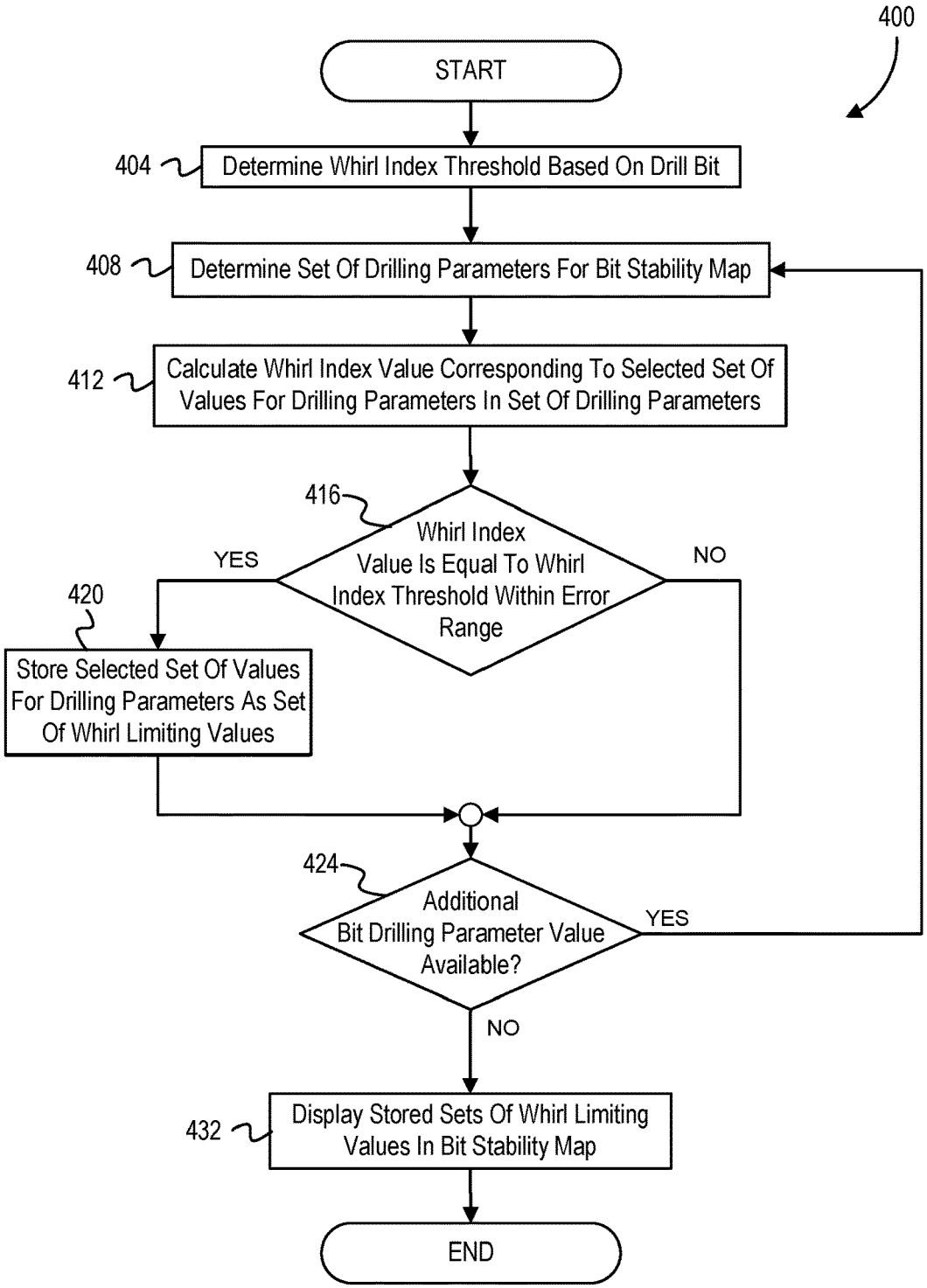
FIG. 4 is a flowchart of operations to generate a bit stability map.

FIG. 4 is a flowchart of operations to generate a bit stability map. A bit stability map can be useful to characterize the backward whirl susceptibility of a drill bit or a class of drill bits. FIG. 4 depicts a flowchart 400 of operations to generate a bit stability map using a system that includes a processor, as described with respect to FIG. 3 above. With reference to FIGS. 1-2, the operations of the flowchart 400 can be used to generate a bit stability map for the drill bit 100 or the drill bit 200. Operations of the flowchart 400 start at block 404.

At block 404, the system determines a whirl index threshold based on a drill bit. With respect to FIG. 3, the whirl index threshold can be determined using methods similar to the operations described above for block 324 after determining what drill bit design is associated the drill bit. For example, the system can determine that the drill bit is associated with a first bit design, look up a whirl index threshold associated with the first bit design in a database, and determine that the whirl index threshold is 75%. Alternatively, the system can determine the whirl index threshold based on a directly-entered value from a user interface.

At block 408, the system determines a set of drilling parameters for a bit stability map. The bit stability map is a multi-dimensional data structure that associates one or more sets of drilling parameters with a corresponding indicator of whether or not a drilling operation is at risk of backward whirl. Example drilling parameters include ROP, ROL bit rotation speed, etc. For example, the sets of drilling parameters can be different bit rotation speeds sharing a ROL. The values for a drilling parameter can be within a range of available values for the drilling parameter. For example, a bit rotation speed value can be selected from a range of bit rotation speeds, wherein the range of bit rotation speeds can be 1 RPM to 200 RPM and the selected number of speeds can be 10, which can result in the set of bit rotation speeds having ten unique speeds distributed between 1 RPM and 200 RPM. For example, the set of bit rotation speeds can be evenly distributed, randomly distributed, etc.

At block 412, the system calculates a whirl index value corresponding to a selected set of values for the drilling parameters in the set of drilling parameters. With respect to FIG. 3, the system can determine the whirl index value using operations similar to or the same as those described for blocks 304-320 above. In some embodiments, the system can choose the least values for each of the drilling parameters in the set of drilling parameters as the initial set of values for the drilling parameters. The system can increment the values in subsequent iterations of block 412 for the drilling parameters. Alternatively, the system can use values determined using a subsequent operation such as those described at block 424 below.

At block 416, the system determines if the whirl index value is equal to the whirl index threshold within an error range. The error range can be a predetermined portion of the whirl index threshold or can be selected dynamically. For example, the error range can be within 1% of the whirl index threshold, within 5% of the whirl index threshold, etc. If the whirl index value exceeds the whirl index threshold using the error range as limits, operations of the flowchart 400 proceed directly to block 424. Otherwise, operations of the flowchart 400 first proceed to block 420.

At block 420, the system stores the selected set of values for the drilling parameters as a set of whirl limiting values. In some embodiments, the whirl limiting values can be stored in a database. For example, a particular whirl limiting set of values can be stored in a database as a set including a WOB value, ROP value and a drilling mud pump rate. The sets of whirl limiting values can be combined to form a stability boundary in the drilling parameters domain, wherein operating at a set of drill parameters beyond the stability boundary risks the initiation/continuation of backward whirl.

At block 424, the system determines if an additional drilling parameter value is available. In some embodiments, an additional drilling parameter value is available if at least one value in the range of available values corresponding to that drilling parameter was not used to calculate the backward whirl index discussed at block 412 above. For example, if rotation speed is one of the drilling parameters for a bit stability map and at least one rotation speed value in the range of rotation speeds was not used to calculate a whirl index at block 412 above, the system can determine that an additional value for a drilling parameter is available. If an additional value for a drilling parameter is available, the system can return to block 408, wherein the drilling parameter value is changed to the available value. Otherwise, the system can proceed to block 432.

At block 432, the system displays the stored sets of whirl limiting values in the bit stability map. The system can display the stored whirl limiting values as points on a plot. Alternatively, the system can display the stored limiting values by generating a connecting line or an interpolation line between the whirl limiting values. In some embodiments, the system can display the whirl limiting values as a three-dimensional plot, wherein the whirl limiting values are used to form a surface in the three-dimensional plot. For example, the system can display WOB, ROP, and drilling fluid density as the three drilling parameters during a drilling operation. Operations of the flowchart 400 can be complete at this point.

The flowcharts described above are provided to aid in understanding the illustrations and is not to be used to limit scope of the claims. The flowcharts includes example operations that can vary within the scope of the claims. Additional operations may be performed; fewer operations may be performed; the operations may be performed in parallel; and the operations may be performed in a different order. For example, operations in FIG. 3 can be performed for multiple sets of drilling parameters substantially simultaneously, where various operations overlap in time. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus, for execution.

Example Data

Figure 5:
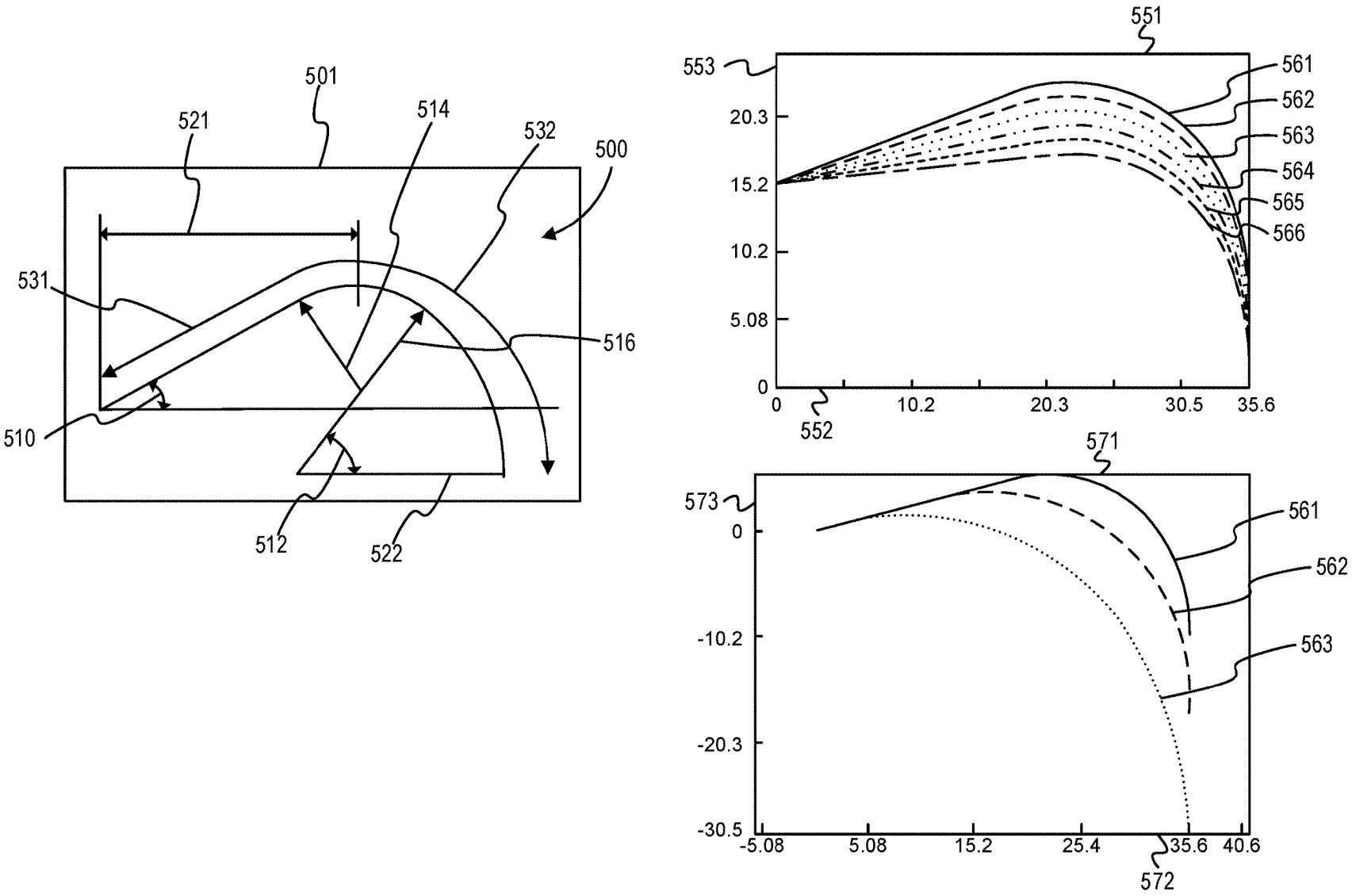
FIG. 5 depicts a first bit design representing a category of bit designs and a set of bit designs based on the category of bit designs.

FIG. 5 depicts a first bit design representing a category of bit designs and a set of bit designs based on the category of bit designs. The diagram box 501 includes a first bit design 500 representing a category of bit designs. The first bit design 500 is formed by a straight line and two arcs characterized by four design variables: a first angle 510, a second angle 512, a first radius 514 and a second radius 516. In addition to the aforementioned design variables, the first bit design 500 can be characterized by a first ratio equal to the ratio of a nose radius 521 to an effective bit radius 522 and a second ratio equal to the ratio of a cone profile length 531 and an out cone profile length 532. The first and second ratios can be represented as $K_1$ and $K_2$ in Equations 6 and 7 below, where $R_n$ represents the nose radius 521, $R_e$ represents the effective bit radius 522, $L_C$ represents the cone profile length 531 and $L_O$ represents the out cone profile length 532:

$$K_l = \frac{R_n}{R_e} \tag{5}$$

$$K_2 = \frac{L_c}{L_o} \tag{6}$$

The bit designs box 551 shows specific geometries of the bit designs represented by a category of bit designs shown in diagram box 501. The horizontal axis 552 represents a bit radius in units of centimeters, and the vertical axis 553 represents bit height in units of centimeters. Each of the bit designs 561-566 in the bit designs box 551 represent a specific bit design based on the bit design represented in the diagram box 501. As discussed above, each of the bit designs can have their own whirl index threshold. Alternatively, each of the bit designs can have a same whirl index threshold with at least one of the other bit designs. A summary of the different bit designs can be found below in Table 1, which includes the first ratio K1, the second ratio K2, the angle A corresponding with the first angle 510, and the whirl index value $WI_1$ (calculated using equation 2) for each of the first bit design 561, second bit design 562, third bit design 563, fourth bit design 564, fifth bit design 565 and sixth bit design 566. As can be seen with Table 1 below, increasing the first angle 510 (which also increases the second ratio K2) decreases the absolute value of the whirl index value of a drill bit, wherein the negative value of $WI_1$ indicates a bit having backward whirl tendency.

TABLE 1

| Bit Design | 561 | 562 | 563 | 564 | 565 | 566 |
|---|---|---|---|---|---|---|
| $WI_1$ (%) | −45 | −37 | −29 | −22 | −14 | −8 |
| $K_1$ (%) | 62 | 62 | 62 | 62 | 62 | 62 |
| $K_2$ (%) | 97 | 98 | 99 | 100 | 102 | 103 |
| A (degree) | 6 | 9 | 12 | 15 | 18 | 21 |

The plot 571 shows additional example bit designs that are based on the category of bit designs represented in the diagram box 501. The horizontal axis 572 represents a bit radius in units of centimeters, and the vertical axis 573 represents bit height in units of centimeters. The first bit design 561 represents a bit design having a whirl index value of −21.98%, the second bit design 562 represents a bit design having a whirl index value of −55.07% and the third bit design 563 represents a bit design having a whirl index value of −121.43%. As shown by each of the bit designs, changes in bit design dimensions can result in significant changes in their corresponding whirl index values.

In addition to changing the bit design parameters shown above, changing the design of the bit cutters on a drill bit can also change the whirl index values corresponding to the drill bit. For example, Table 2 below shows that increasing the back rake angle of a cutter on a drill bit can decrease the absolute value of the corresponding whirl index values WI:

TABLE 2

| Back Rake angle (degree) | 10 | 15 | 20 |
|---|---|---|---|
| WI (%) | −30.18 | −21.98 | −15.89 |

By performing one or more tests of the back rake angle or other bit design parameters such as a cutter side rake distribution of the drill bit, a non-cutting element distribution of the drill bit and a gage pad length of the drill bit, a database of bit design parameters and their corresponding whirl index values can be generated. In some embodiments, a computing system can use this database of bit design parameters to determine a whirl index value based on a corresponding bit design parameter matching with a parameter in the database of bit design parameters. Alternatively, a computing system can estimate a whirl index value with a corresponding set of bit design parameters by using an extrapolation method with the one or more bit design parameters in the database of bit design parameters closest to the corresponding set of bit design parameters.

Figure 6:
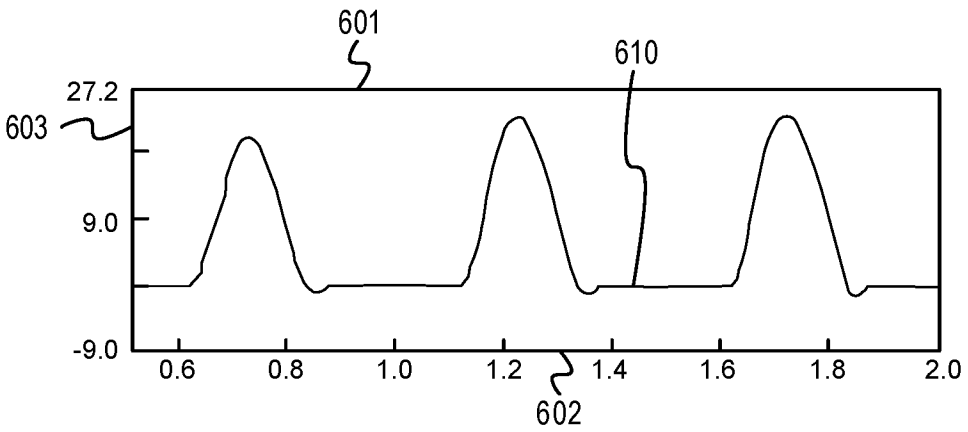
FIG. 6 is a set of plots that show the walk forces experienced by two cutters on the same drill bit over time during an example drilling operation.
Figure 6:
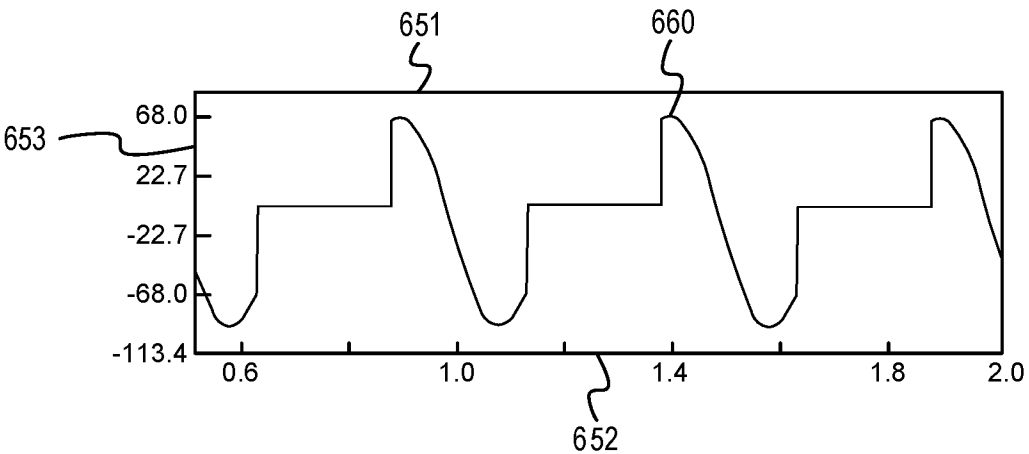

FIG. 6 is a set of plots that show the walk forces experienced by two cutters on the same drill bit over time during an example drilling operation. The plot 601 shows an example walk force (represented by a force line 610) experienced by a cone cutter on a blade of a drill bit during an example drilling operation. In the plot 601, the horizontal axis 602 represents time in units of seconds and the vertical axis 603 represents a measured walk force in units of kgs. With reference to FIG. 1 above, the cone cutter may comprise the bit cutter 110, which is on the drill bit 100 and is used to lengthen a borehole in the direction of the bit face 103. The force line 610 ranges between 0 kgs and 23.2 kgs and has a maximum measured walk force of approximately 23.2 kgs.

The plot 651 shows an example walk force (represented by a force line 660) experienced by a gage cutter on a blade of the same drill bit during the example drilling operation. With reference to FIG. 1 above, the gage cutter may comprise the bit cutter 111, wherein the position of the bit cutter 111 would allow the bit cutter 111 to act as a gage cutter by expanding a borehole size in the radial direction of the drill bit 100. The horizontal axis 652 represents time in units of seconds and the vertical axis 653 represents a measured walk force in units of kgs. In contrast to the force line 610, the range of the walk forces shown by the force line 660 is far greater, ranging from approximately −95.3 kgs to 68.0 kgs. With reference to FIG. 3, the method of adding force contributions from individual elements of a drill bit to determine a total walk force value as described for block 316 above can increase the accuracy of calculations using FW by taking into account the specific force contributions of individual components of a drill bit.

Figure 7:
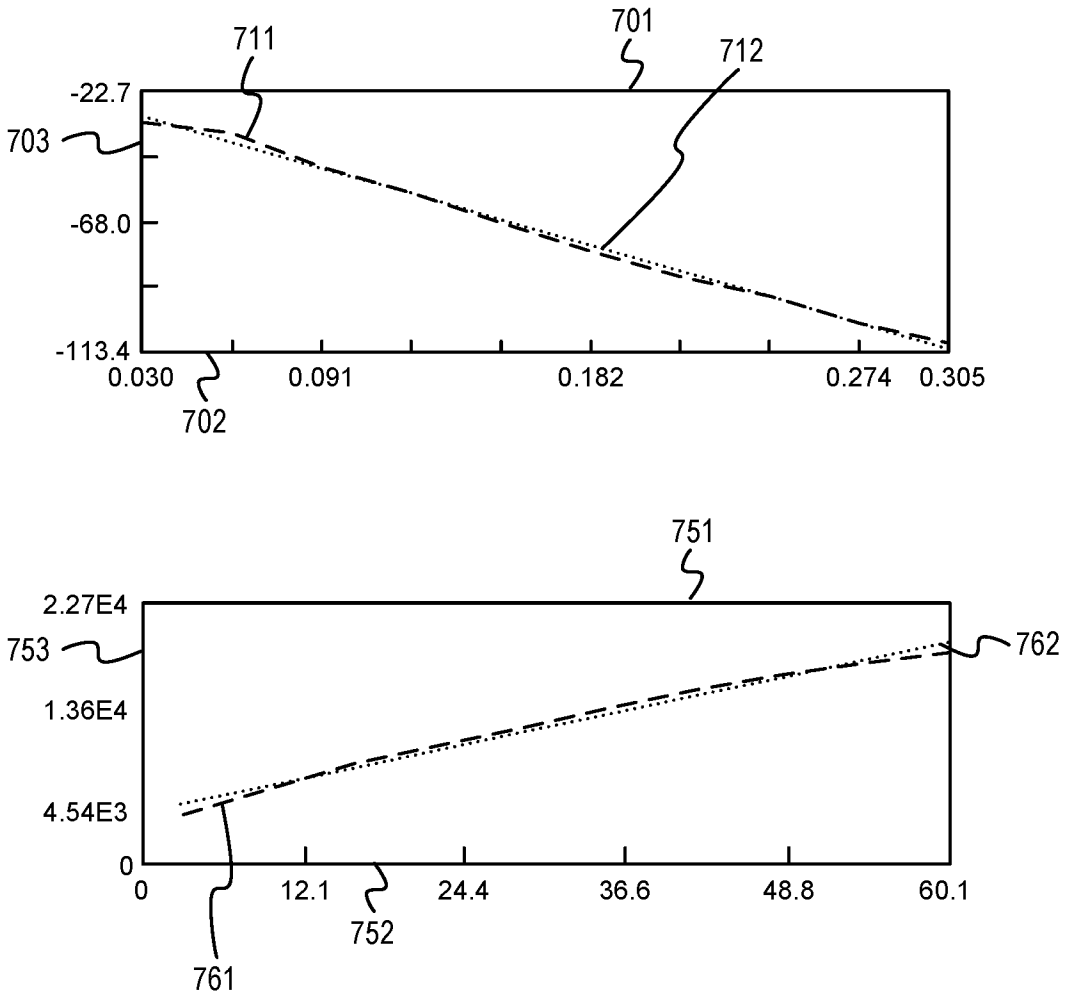
FIG. 7 is a set of plots that includes a rate of lateral penetration (ROL) vs. bit walk force (FW) plot and an axial rate of penetration (ROP) vs. weight on bit (WOB) plot.

FIG. 7 is a set of plots that includes a rate of lateral penetration (ROL) vs. bit walk force (FW) plot and an axial rate of penetration (ROP) vs. weight on bit (WOB) plot. The plot 701 has a horizontal axis 702 that represents ROL in units of meters per hour (m/hr), and the vertical axis 503 represents FW in units of kilograms (kgs). The dashed line 711 represents a model simulation result and the dotted line 712 represents a linear fitting of the available data for the ROL values. Similarly, the plot 751 has a horizontal axis 752 that represents ROP in units of m/hr and a vertical axis 703 represents WOB in units of kgs. The dashed line 761 represents a model simulation result and the dotted line 762 represents a linear fitting of the available data to the ROP values. A system can use the model simulation results represented by the dashed lines 711 and 761 to determine the derivatives version of the whirl index $WI_1$ shown in Equation 2 above. Alternatively, the linear fittings represented by the dotted lines 712 and 762 can be used to quickly determine the non-derivatives version of the whirl index value $WI_2$ shown in Equation 4. In some embodiments, a whirl index value calculated from the derivative version of the whirl index shown in Equation 2 can be more accurate than the non-derivative version of the whirl index shown in Equation 4.

Figure 8:
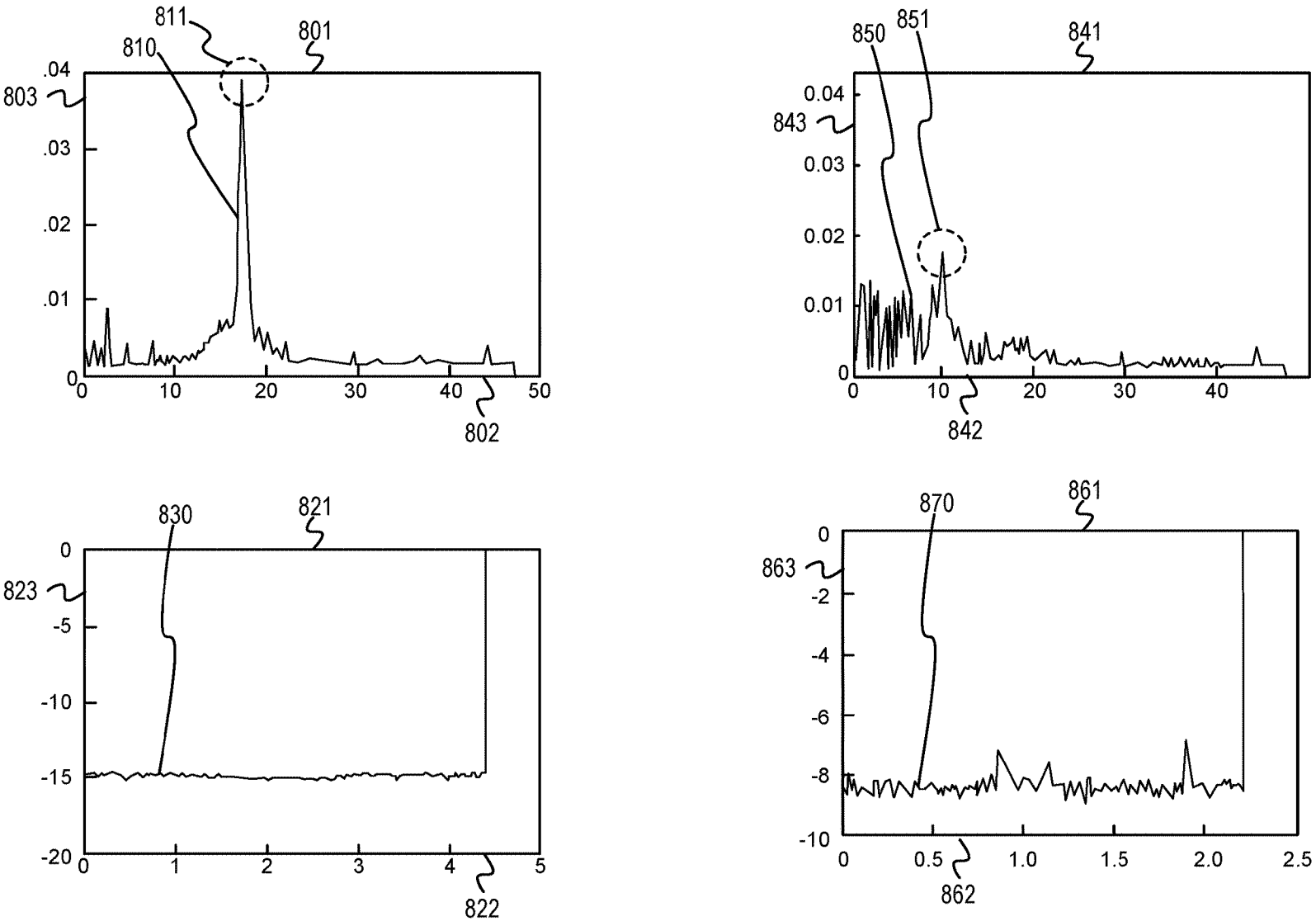
FIG. 8 is a set of plots that show the peak frequencies and measured backward whirl frequencies for two instances corresponding with a whirl index greater than a whirl index threshold.

FIG. 8 is a set of plots that show the peak frequencies and measured backward whirl frequencies for two instances corresponding with a whirl index greater than a whirl index threshold. The first plot 801 and second plot 821 represent a spectrum plot of a bit lateral acceleration and a backward whirl frequency plot, respectively, for a test drilling operation using an 21.6 centimeters diameter drill bit having 5 straight blades and a cone angle of 5 degrees. The backward whirl frequency plot can be calculated from the slope of the unwrapped phase angle using Equations 7 and 8 below, wherein Ya and Xa are bit lateral accelerations, ω and Ω are bit rotational speed and bit whirl speed, t is time, φ is an unwrapped phase angle, and $\varphi_0$ is an initial unwrapped phase angle, allowing the calculation of the backward whirl frequency as a function of drilling time to be determined as:

$$\varphi(t) = \operatorname{atan}\left(\frac{Ya}{Xa}\right) + \varphi 0 = (\omega - \Omega)t + \varphi 0 \tag{7}$$

$$(\omega - \Omega) = \text{the slope of } \varphi(t) \tag{8}$$

During the test drilling operation, the test drilling parameters include an average bit rotational frequency of 2.5 Hz. With reference to FIG. 3, the operations disclosed above in flowchart 300 can be used to determine the whirl index values from their corresponding test parameters. The whirl index value for the drill bit operating at the test drilling parameters is −192.59%, whereas the whirl index threshold for this drill bit is 100%. Thus, the operations disclosed in the flowchart 300 would determine that the drill bit operating under the drilling parameters discussed in this case would experience backward whirl. The average backward whirl frequency shown in a backward whirl frequency line 830 of the second plot 821 is approximately −15 Hz, where the negative sign means the whirl is backwards. This backward whirl frequency happens to be equal to the multiplication of bit rotational frequency (ω=2.5 Hz) by one plus the number of blades $N_b$ in the drill bit, which is shown by Equation 9 below:

$$\Omega = -\omega(N_b + 1) \tag{9}$$

As shown in Equation 9, the backward whirl can be induced by cutters on the bit, independent of any effects from the bit gage pad or BHA stabilizer.

The first plot 801 has a horizontal axis 802 representing frequency in units of hertz (Hz) and a vertical axis 803 representing a spectrum amplitude in dimensionless units. The plot line 810 has a frequency peak 811 at 17.5 Hz. The frequency of the drill bit itself is 2.5 Hz, reducing the contribution of backward whirl to the peak frequency to 15 Hz, which is equal to the predicted backward whirl frequency. The results shown in the second plot 821 further support the accuracy of the operations described above. The second plot 821 has a horizontal axis 822 representing time in units of hours and a vertical axis 823 representing frequency in units of Hz. The second plot 821 also has the backward whirl frequency line 830 that tracks the estimated backward whirl frequency and is shown in the second plot 821 to oscillate at a frequency of approximately −15 Hz for the majority of the drilling operation. Thus, as initially predicted using the whirl index value, the drill bit experiences backward whirl at the provided operating parameters and this type of backward whirl is induced by cutters on bit.

The third plot 841 and fourth plot 861 represent a frequency plot and a backward whirl plot, respectively, for a test drilling operation using an 22.2 centimeters diameter drill bit having 6 blades and sensors installed on the bit to measure bit vibration during drilling. During the test drilling operation, the test drilling parameters include an average bit rotational frequency of 1.19 Hz. With reference to FIG. 3, the operations disclosed above in flowchart 300 can be used to determine that the corresponding whirl index value is −121% whereas the whirl index threshold corresponding to this drill bit is 100% in a database. Thus, the operations disclosed in the flowchart 300 would determine that the drill bit operating under the drilling parameters discussed above would experience backward whirl.

Using equation 8 or 9 above, the backward whirl frequency induced by cutters should be 8.33 Hz. The third plot 841 has a horizontal axis 842 representing frequency in units of Hz and a vertical axis 843 representing an amplitude of spectrum in dimensionless units. The plot line 850 has a frequency peak 851 at 9.52 Hz. Because the rotational frequency of the drill bit is 1.19 Hz, the contribution of backward whirl to the peak frequency reduces to 8.33 Hz, which is the frequency predicted using Equation 8. The results shown in the fourth plot 861 further support the accuracy of the operations described above. The fourth plot 861 has a horizontal axis 862 representing time in units of hours and a vertical axis 863 representing frequency in units of Hz. The fourth plot 861 also has a backward whirl frequency line 870 that tracks the estimated backward whirl frequency and is shown in the fourth plot 861 to oscillate at frequency of approximately −8.33 Hz for the majority of the drilling operation. Thus, as initially predicted using the whirl index value, the drill bit experiences backward whirl at the provided operating parameters.

Figure 9:
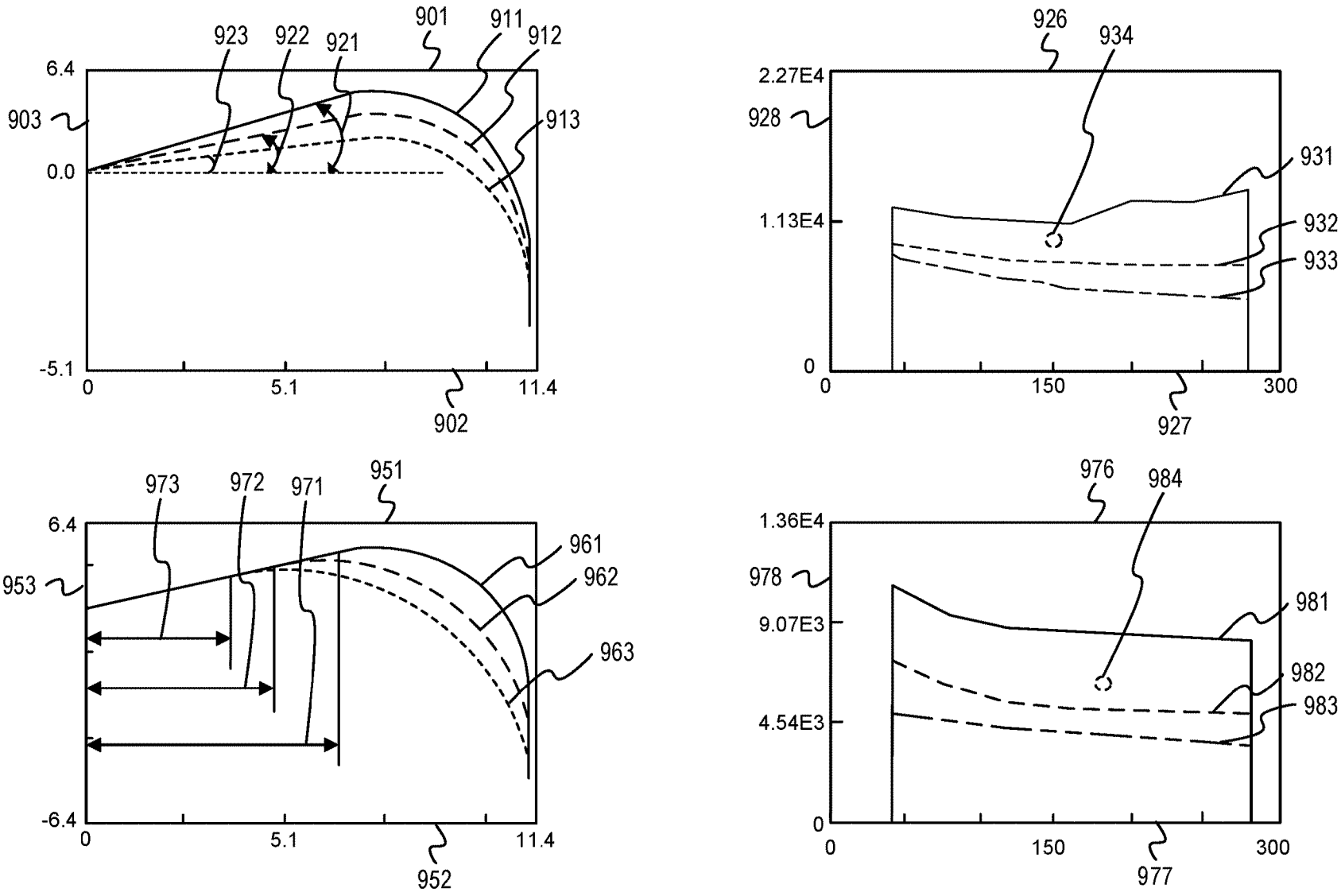
FIG. 9 is a set of bit designs and their corresponding bit stability maps.

FIG. 9 is a set of bit designs and their corresponding bit stability maps. The bit design box 901 shows a set of different bit designs based on a category of bit designs. The bit design box 901 includes a first bit design 911 that has a cone angle 921 of 7 degrees, a second bit design 912 that has a cone angle 922 of 12 degrees, and a third bit design 913 that has a cone angle 923 of 17 degrees. Both the horizontal axis 902 and the vertical axis 903 of the bit design box 901 are in units of centimeters. With reference to FIG. 4, the operations described above in the flowchart 400 for each of the bits represented by the bit designs 911, 912, 913 in the bit design box 901 can be used to generate a bit stability map 926.

As shown in the bit stability map 926, increasing the cone angle of a bit design can increase the overall region of stability. The bit stability map 926 has a horizontal axis 927 that represents rotation speed in units of rotations per minute (RPM) and a vertical axis 928 that represents WOB in units of kgs. The first boundary 931 represents the stability boundary for the first bit design 911, the second boundary 932 represents the stability boundary for the second bit design 912, and the third boundary 933 represents a stability boundary for the third bit design 913. For any bit design rotating at a particular RPM, any WOB below its corresponding stability boundary is considered stable and would not be predicted to be at risk of backward whirl. For example, the first bit design 911, which corresponds with the first boundary 931, would be stable and not at risk of backward whirl when operating at the drilling parameters corresponding with the point 934. However, the bit designs 912 and 913, which respectively correspond with the second boundary 932 and third boundary 933, would not be stable and would be at risk of backward whirl at the drilling parameters corresponding with the point 934.

The bit design box 951 shows another set of bit designs. The bit design box 951 includes a fourth bit design 961 that has a cone length 971 of 6.4 centimeters, a fifth bit design 962 that has a cone length 972 of 4.6 centimeters, and a sixth bit design 963 that has a cone length 973 of 3.8 centimeters. Both the horizontal axis 952 and the vertical axis 953 of the bit design box 951 are in units of centimeters. With reference to FIG. 4, using the operations described above for the flowchart 400 for each of the bits represented by the bit designs in the bit design box 901 can be used to generate a bit stability map 976.

As shown in the bit stability map 976, increasing the cone length of a bit design can increase the overall region of stability. The bit stability map 976 has a horizontal axis 977 that represents rotation speed in units of rotations per minute (RPM) and a vertical axis 978 that represents WOB in units of kgs. The fourth boundary 981 represents the stability boundary for the fourth bit design 961, the fifth boundary 982 represents the stability boundary for the fifth bit design 962, and the sixth boundary 983 represents a stability boundary for the sixth bit design 963. For any bit design rotating at a particular RPM, any WOB below its corresponding stability boundary is considered stable and would not be predicted to be at risk of backward whirl. For example, the fourth bit design 961, which corresponds with the fourth boundary 981, would be stable and not at risk of backward whirl at the drilling parameters corresponding with the point 984. However, the fifth bit design 962 and sixth bit design 963, which respectively correspond with the fifth boundary 982 and sixth boundary 983, would not be stable and would be at risk of experiencing backward whirl when operating at the drilling parameters corresponding with the point 984.

With reference to FIG. 3 above, each column in Table 3 below represents a different bit design A-L, wherein their corresponding whirl index value are determined using the operations of the flowchart 300. In addition to the whirl index value, each column includes a measurement of the bit size, the number of blades on the drill bit, whether or not backward whirling occurred and whether backward whirling was predicted, wherein the whirl index threshold for each of the bit designs in Table 3 share a whirl index threshold of 100%. As shown in Table 3, for each drill bit where backward whirling was predicted, backward whirling occurred and for each drill bit where backward whirling was not predicted, backward whirling did not occur. As shown in Table 3 below, the operations described above for the flowchart 300 of FIG. 3 are effective in predicting whether or not a drill bit will experience backward whirl.

TABLE 3

| Bit | A | B | C | D | E | F | G | H | I | J |
|---|---|---|---|---|---|---|---|---|---|---|
| Bit Size | 8.5 | 8.75 | 8.75 | 8.5 | 8.5 | 8.5 | 8.5 | 8.75 | 8.5 | 12.25 |
| Number of Blades | 5 | 6 | 6 | 6 | 6 | 6 | 7 | 6 | 7 | 7 |
| WI (%) | −192.59 | −103.0 | −77.21 | −98.61 | −120.64 | −131.12 | −64.8 | −54.3 | −74.42 | −51.27 |
| Backward whirl Occurred ? | Y | Y | N | N | Y | Y | N | N | N | N |
| Backward Whirl Predicted ? | Y | Y | N | N | Y | Y | N | N | N | N |

Example Onshore Drilling Platform

Figure 10:
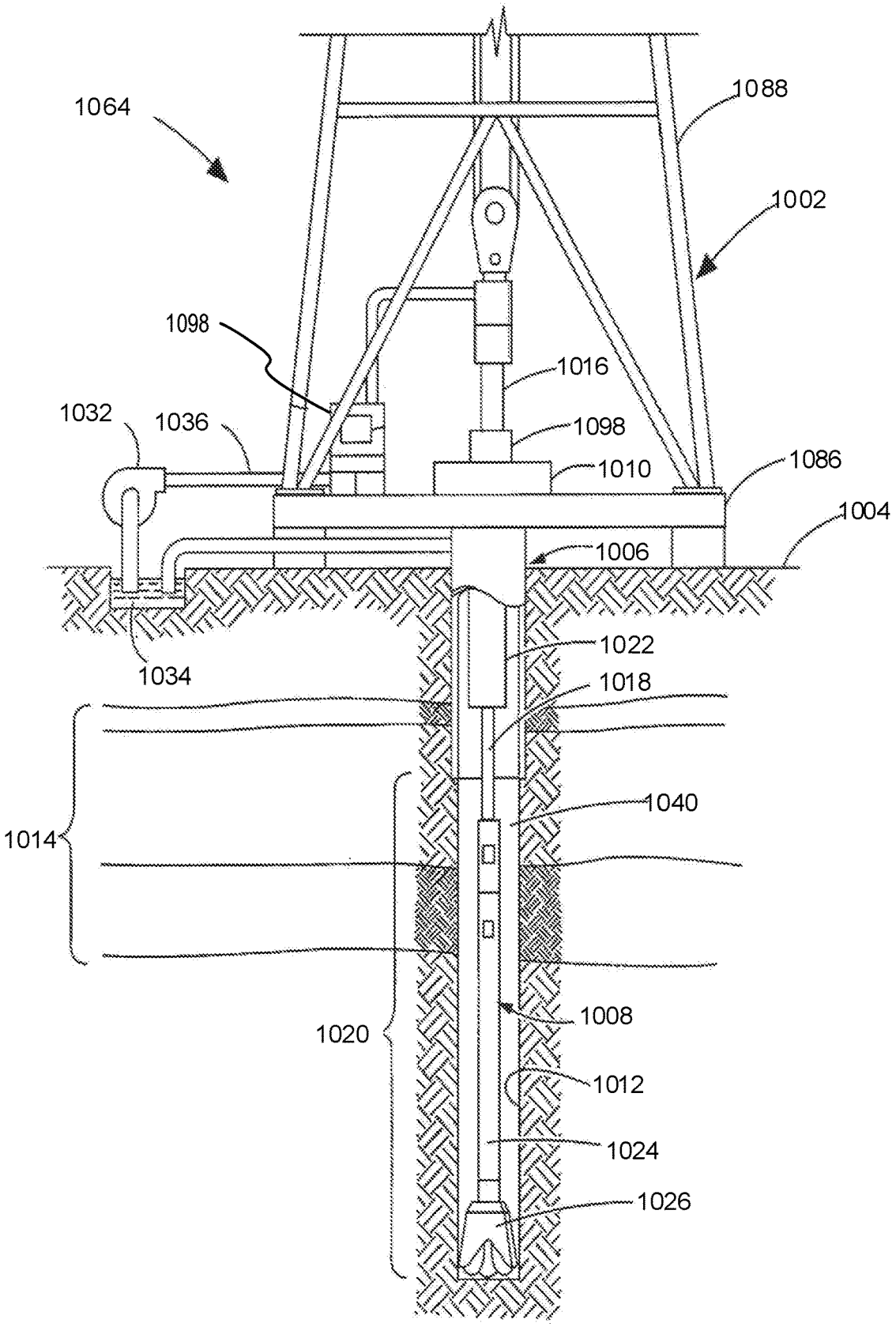
FIG. 10 is an elevation view of an onshore platform that includes a drill bit in a borehole.

FIG. 10 is an elevation view of an onshore platform that includes a drill bit in a borehole. FIG. 10 shows a system 1064 that includes a portion of a drilling rig 1002 located at the surface 1004 of a well 1006. Drilling of oil and gas wells is commonly carried out using a string of drill pipes connected together so as to form a drilling string 1008 that is lowered through a rotary table 1010 into a borehole 1012. Here a drilling platform 1086 is equipped with a derrick 1088 that supports a hoist.

The drilling rig 1002 may thus provide support for the drill string 1008. The drill string 1008 may operate to rotate the rotary table 1010 for drilling the borehole 1012 through subsurface formations 1014. The drill string 1008 may include a Kelly 1016, drill pipe 1018, and a bottom hole assembly 1020, perhaps located at the lower portion of the drill pipe 1018.

The bottom hole assembly 1020 may include drill collars 1022, a down hole tool 1024, and a drill bit 1026. The drill bit 1026 may operate to create a borehole 1012 by penetrating the surface 1004 and subsurface formations 1014. The down hole tool 1024 may comprise any of a number of different types of tools including measurement while drilling (MWD) tools, logging while drilling (LWD) tools, and others.

During drilling operations, the drill string 1008 (perhaps including the Kelly 1016, the drill pipe 1018, and the bottom hole assembly 1020) may be rotated by the rotary table 1010. In addition to, or alternatively, the bottom hole assembly 1020 may also be rotated by a motor such as a mud motor that is located down hole. The drill collars 1022 may be used to add weight to the drill bit 1026. The drill collars 1022 may also operate to stiffen the bottom hole assembly 1020, allowing the bottom hole assembly 1020 to transfer the added weight to the drill bit 1026, and in turn, to assist the drill bit 1026 in penetrating the surface 1004 and subsurface formations 1014. In the event of backward whirl, the drill bit 1026, which may be similar to or identical to the drill bits 100, 200 in FIGS. 1 and 2, respectively, can eccentrically rotate around the perimeter of the borehole 1012 in a direction opposite to its drilling direction. Backward whirl can widen the borehole 1012, waste energy/drilling fluid, and damage components of the bottom hole assembly 1020. With reference to FIGS. 3 and 4 above, the computer system 1098 can perform some or all of the operations described above in the flowcharts 300-400 to determine whether the drill bit 1026 is experiencing, or is predicted to experience, backward whirl.

During drilling operations, a mud pump 1032 may pump drilling fluid (sometimes known by those of ordinary skill in the art as "drilling mud") from a mud pit 1034 through a hose 1036 into the drill pipe 1018 and down to the drill bit 1026. The drilling fluid can flow out from the drill bit 1026 and be returned to the surface 1004 through an annular area 1040 between the drill pipe 1018 and the sides of the borehole 1012. The drilling fluid may then be returned to the mud pit 1034, where such fluid is filtered. In some embodiments, the drilling fluid can be used to cool the drill bit 1026, as well as to provide lubrication for the drill bit 1026 during drilling operations. Additionally, the drilling fluid may be used to remove subsurface formation 1014 cuttings created by operating the drill bit 1026. It is the images of these cuttings that many embodiments operate to acquire and process.

Example Computer

Figure 11:
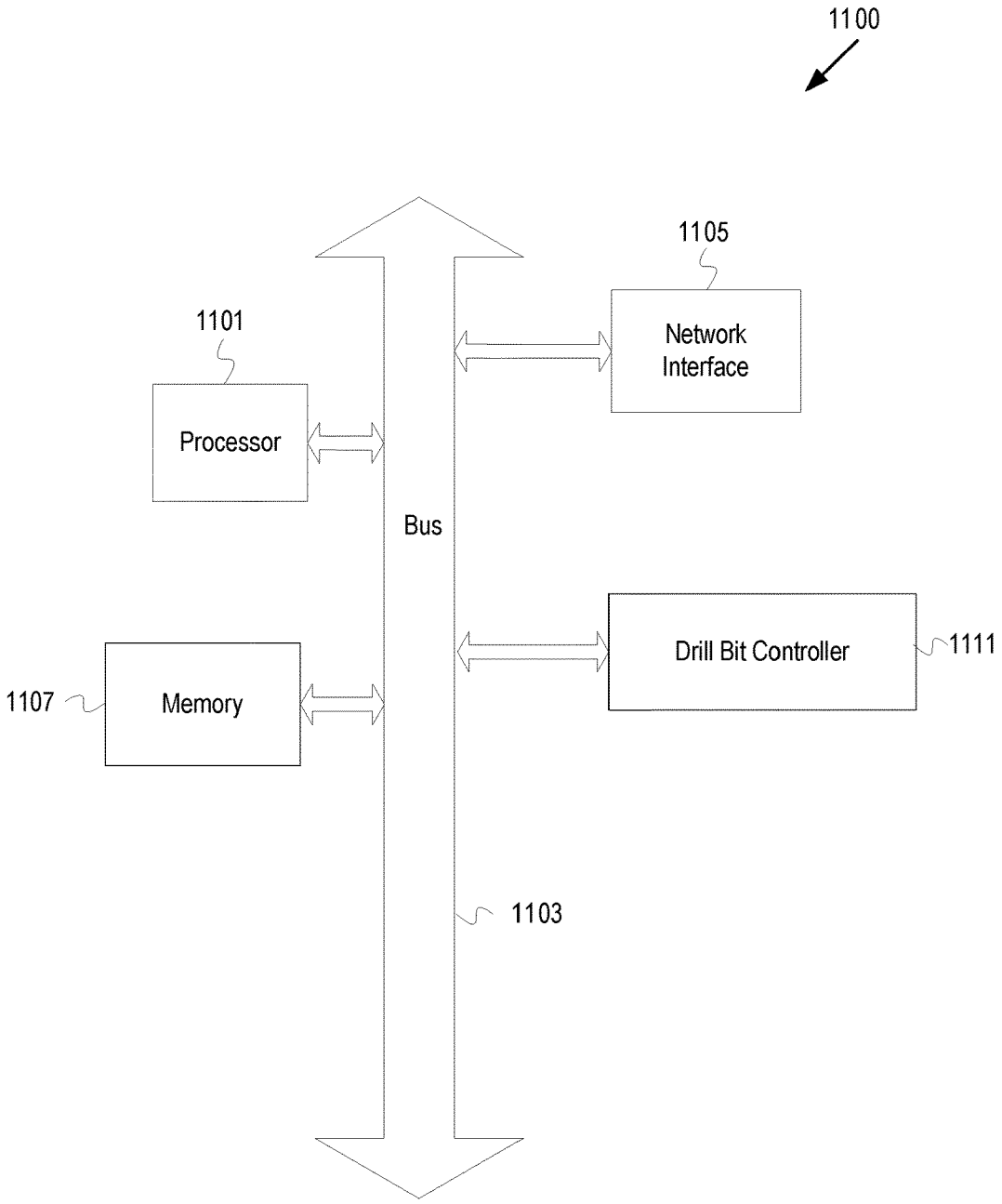
FIG. 11 depicts an example computer device.

FIG. 11 is schematic diagram of an example computer device. A computer device 1100 includes a processor 1101 (possibly including multiple processors, multiple cores, multiple nodes, and/or implementing multi-threading, etc.). The computer device 1100 includes a memory 1107. The memory 1107 can be system memory. For example, the memory 1107 can include one or more of cache, SRAM, DRAM, zero capacitor RAM, Twin Transistor RAM, eDRAM, EDO RAM, DDR RAM, EEPROM, NRAM, RRAM, SONOS, PRAM, etc. or any one or more of the above already described possible realizations of machine-readable media. The computer device 1100 also includes a bus 1103. For example, the bus 1103 can include a PCI, ISA, PCI-Express, HyperTransport® bus, InfiniBand® bus, NuBus, etc. The system can also include a network interface 1105. For example, the interface 1105 can include a Fiber Channel interface, an Ethernet interface, an internet small computer system interface, SONET interface, wireless interface, etc.

The computer device 1100 includes a drill bit controller 1111. The drill bit controller 1111 can perform one or more operations described above. For example, the drill bit controller 1111 can determine that a drilling operation is experiencing backward whirl or at significant risk of backward whirl. Additionally, the drill bit controller 1111 can modify drilling parameters or an assigned bit design in response to the determination that a drilling operation is experiencing backward whirl or at significant risk of backward whirl.

Any one of the previously described functionalities can be partially (or entirely) implemented in hardware and/or on the processor 1101. For example, the functionality can be implemented with an application specific integrated circuit, in logic implemented in the processor 1101, in a co-processor on a peripheral device or card, etc. Further, realizations can include fewer or additional components not illustrated in FIG. 11. For example, the computer device 1100 can include one or more video cards, audio cards, additional network interfaces, peripheral devices, etc. The processor 1101 and the network interface 1105 are coupled to the bus 1103. Although illustrated as being coupled to the bus 1103, the memory 1107 can be coupled to the processor 1101. The computer device 1100 can be a device at the surface and/or integrated into component(s) in the borehole. For example, with reference to FIG. 10, the computer system 1098 may comprise one or more of the computer devices 1100.

By implementing various embodiments, as described herein, backward whirl during drilling operations can be reduced, or possibly eliminated. Reducing or eliminating backward whirl can increase the efficiency of drilling operations, increase the accuracy of hole size estimates, and increase the useful lifespan of the drill bit and the attached arm.

As will be appreciated, aspects of the disclosure can be embodied as a system, method or program code/instructions stored in one or more machine-readable media. Aspects can take the form of hardware, software (including firmware, resident software, micro-code, etc.), or a combination of software and hardware aspects that can all generally be referred to herein as a "circuit" or "system." The functionality presented as individual units in the example illustrations can be organized differently in accordance with any one of platform (operating system and/or hardware), application ecosystem, interfaces, programmer preferences, programming language, administrator preferences, etc.

Any combination of one or more machine readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

Additional Terminology and Variations

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. A set of items can have only one item or more than one item.

Example Embodiments

Example embodiments include the following:

Embodiment 1: An apparatus comprising: a processor; and a machine-readable medium having program code executable by the processor to cause the apparatus to, determine a first parameter based on a walk force of a drill bit, generate a whirl index value that comprises a ratio of drilling parameters, wherein at least one parameter of the ratio of drilling parameters is the first parameter, and based on a determination that the whirl index value exceeds a whirl index threshold, determine that a drilling operation induces backward whirl, wherein the drilling operation is characterized by the drilling parameters.

Embodiment 2: The apparatus of Embodiment 1, wherein the ratio of drilling parameters further comprises a second parameter, wherein the second parameter is based on at least one of a weight on bit of the drill bit, a rate of penetration of the drill bit, and a derivative of the weight on bit of the drill bit to the rate of penetration of the drill bit.

Embodiment 3: The apparatus of Embodiments 1 or 2, wherein the first parameter is based on at least one of a rate of lateral penetration of the drill bit and a derivative of the walk force to the rate of lateral penetration of the drill bit.

Embodiment 4: The apparatus of any of Embodiments 1-3, wherein the program code further comprises instructions to generate a bit stability map, wherein the bit stability map associates sets of drilling parameters to an indicator of whether or not operating at each of the sets of drilling parameters will induce backward whirl, and wherein the bit stability map is specific to a set of bit designs.

Embodiment 5: The apparatus of any of Embodiments 1-4, wherein the whirl index threshold is selected from a set of whirl index thresholds based on a bit design parameter of the drill bit, wherein the bit design parameter is based on at least one of a bit radius, a bit axial location, and a bit cone angle.

Embodiment 6: The apparatus of any of Embodiments 1-5, wherein the program code to generate the whirl index value further comprises program code to determine the whirl index value based on at least one of a back rake angle of the drill bit, cutter side rake distribution of the drill bit, a non-cutting element distribution of the drill bit and a gage pad length of the drill bit.

Embodiment 7: The apparatus of any of Embodiments 1-6, further comprising: a drill string in a borehole, wherein the drill bit is attached to the drill string; and wherein the program code comprises instructions to adjust a drilling parameter of the drill bit in response to the determination that the whirl index value exceeds the whirl index threshold.

Embodiment 8: The apparatus of any of Embodiments 1-7, wherein the program code to adjust the drilling parameter comprises instructions to adjust a rate of lateral penetration of the drill bit.

Embodiment 9: One or more non-transitory machine-readable media comprising program code for determining that a drilling operation induces backward whirl, the program code to: determine a first parameter based on a walk force of a drill bit; generate a whirl index value that comprises a ratio of drilling parameters, wherein at least one parameter of the ratio of drilling parameters is the first parameter; and based on a determination that the whirl index value exceeds a whirl index threshold, determine that the drilling operation induces backward whirl, wherein the drilling operation is characterized by the drilling parameters.

Embodiment 10: The machine-readable media of Embodiment 9, wherein the ratio of drilling parameters further comprises a second parameter, wherein the second parameter is based on at least one of a weight on bit of the drill bit, a rate of penetration of the drill bit, and a derivative of the weight on bit of the drill bit to the rate of penetration of the drill bit.

Embodiment 11: The machine-readable media of Embodiments 9 or 10, wherein the first parameter is based on at least one of a rate of lateral penetration of the drill bit and a derivative of the walk force to the rate of lateral penetration of the drill bit.

Embodiment 12: The machine-readable media of any of Embodiments 9-11, further comprising program code to generate a bit stability map, wherein the bit stability map associates sets of drilling parameters to an indicator of whether or not operating at each of the sets of drilling parameters will induce backward whirl, and wherein the bit stability map is specific to a set of bit designs.

Embodiment 13: The machine-readable media of any of Embodiments 9-12, wherein the whirl index threshold is selected from a set of whirl index thresholds based on a bit design parameter of the drill bit, wherein the bit design parameter is based on at least one of a bit radius, a bit axial location, and a bit cone angle.

Embodiment 14: The machine-readable media of any of Embodiments 9-13, further comprising program code to adjust a drilling parameter of the drill bit in response to the determination that the whirl index value exceeds the whirl index threshold.

Embodiment 15: A method comprising: determining a first parameter based on a walk force of a drill bit; generating a whirl index value that comprises a ratio of drilling parameters, wherein at least one parameter of the ratio of drilling parameters is the first parameter; and based on a determination that the whirl index value exceeds a whirl index threshold, determining that a drilling operation induces backward whirl, wherein the drilling operation is characterized by the drilling parameters.

Embodiment 16: The method of Embodiment 15, wherein the ratio of drilling parameters further comprises a second parameter, wherein the second parameter is based on at least one of a weight on bit of the drill bit, a rate of penetration of the drill bit, and a derivative of the weight on bit of the drill bit to the rate of penetration of the drill bit.

Embodiment 17: The method of Embodiments 15 or 16, wherein the first parameter is based on at least one of a rate of lateral penetration of the drill bit and a derivative of the walk force to the rate of lateral penetration of the drill bit.

Embodiment 18: The method of any of Embodiments 15-17, further comprising generating a bit stability map, wherein the bit stability map associates sets of drilling parameters to an indicator of whether or not operating at each of the sets of drilling parameters will induce backward whirl, and wherein the bit stability map is specific to a set of bit designs.

Embodiment 19: The method of any of Embodiments 15-18, wherein the whirl index threshold is selected from a set of whirl index thresholds based on a bit design parameter of the drill bit, wherein the bit design parameter is based on at least one of a bit radius, a bit axial location, and a bit cone angle.

Embodiment 20: The method of any of Embodiments 15-19, further comprising adjusting a drilling parameter of the drill bit in response to the determination that the whirl index value exceeds the whirl index threshold.

What is claimed is:

1. An apparatus comprising:

a processor; and a machine-readable medium having program code executable by the processor to cause the apparatus to, determine a first parameter based on a derivative of a walk force to a rate of lateral penetration of a drill bit while the drill bit is rotating in a bit rotation direction when drilling a borehole, generate a whirl index value that comprises a ratio of drilling parameters, wherein the drilling parameters include the first parameter and weight on bit, based on a determination that the whirl index value exceeds a whirl index threshold, determine that a drilling operation induces backward whirl, wherein the drilling operation is characterized by the drilling parameters, and adjust a drilling parameter of the drill bit during the drilling operation in response to the determination that the whirl index value exceeds the whirl index threshold.

2. The apparatus of claim 1, wherein the ratio of drilling parameters further comprises a second parameter, wherein the second parameter is based on at least one of a weight on bit of the drill bit, a rate of penetration of the drill bit, and a derivative of the weight on bit of the drill bit to the rate of penetration of the drill bit.

3. The apparatus of claim 1, wherein the program code further comprises instructions to generate a bit stability map, wherein the bit stability map associates sets of drilling parameters to an indicator of whether or not operating at each of the sets of drilling parameters will induce backward whirl, and wherein the bit stability map is specific to a set of bit designs.

4. The apparatus of claim 1, wherein the whirl index threshold is selected from a set of whirl index thresholds based on a bit design parameter of the drill bit, wherein the bit design parameter is based on at least one of a bit radius, a bit axial location, and a bit cone angle.

5. The apparatus of claim 1, wherein the program code to generate the whirl index value further comprises program code to determine the whirl index value based on at least one of a back rake angle of the drill bit, cutter side rake distribution of the drill bit, a non-cutting element distribution of the drill bit and a gage pad length of the drill bit.

6. The apparatus of claim 1, further comprising:

a drill string in a borehole, wherein the drill bit is attached to the drill string.

7. The apparatus of claim 6, wherein the program code to adjust the drilling parameter comprises instructions to adjust a rate of lateral penetration of the drill bit.

8. One or more non-transitory machine-readable media comprising program code for determining that a drilling operation induces backward whirl, the program code to:

determine a first parameter based on a derivative of a walk force to a rate of lateral penetration of a drill bit while the drill bit is rotating in a bit rotation direction when drilling a borehole;

generate a whirl index value that comprises a ratio of drilling parameters, wherein the drilling parameters include the first parameter and weight on bit;

based on a determination that the whirl index value exceeds a whirl index threshold, determine that the drilling operation induces backward whirl, wherein the drilling operation is characterized by the drilling parameters; and adjust a drilling parameter of the drill bit during the drilling operation in response to the determination that the whirl index value exceeds the whirl index threshold.

9. The machine-readable media of claim 8, wherein the ratio of drilling parameters further comprises a second parameter, wherein the second parameter is based on at least one of a weight on bit of the drill bit, a rate of penetration of the drill bit, and a derivative of the weight on bit of the drill bit to the rate of penetration of the drill bit.

10. The machine-readable media of claim 8, further comprising program code to generate a bit stability map, wherein the bit stability map associates sets of drilling parameters to an indicator of whether or not operating at each of the sets of drilling parameters will induce backward whirl, and wherein the bit stability map is specific to a set of bit designs.

11. The machine-readable media of claim 8, wherein the whirl index threshold is selected from a set of whirl index thresholds based on a bit design parameter of the drill bit, wherein the bit design parameter is based on at least one of a bit radius, a bit axial location, and a bit cone angle.

12. A method comprising:

determining a first parameter based on a derivative of a walk force to a rate of lateral penetration of a drill bit while the drill bit is rotating in a bit rotation direction when drilling a borehole;

generating a whirl index value that comprises a ratio of drilling parameters, wherein the drilling parameters include the first parameter and weight on bit;

based on a determination that the whirl index value exceeds a whirl index threshold, determining that a drilling operation induces backward whirl, wherein the drilling operation is characterized by the drilling parameters; and adjusting a drilling parameter of the drill bit during the drilling operation in response to the determination that the whirl index value exceeds the whirl index threshold.

13. The method of claim 12, wherein the ratio of drilling parameters further comprises a second parameter, wherein the second parameter is based on at least one of a weight on bit of the drill bit, a rate of penetration of the drill bit, and a derivative of the weight on bit of the drill bit to the rate of penetration of the drill bit.

14. The method of claim 12, further comprising generating a bit stability map, wherein the bit stability map associates sets of drilling parameters to an indicator of whether or not operating at each of the sets of drilling parameters will induce backward whirl, and wherein the bit stability map is specific to a set of bit designs.

15. The method of claim 12, wherein the whirl index threshold is selected from a set of whirl index thresholds based on a bit design parameter of the drill bit, wherein the bit design parameter is based on at least one of a bit radius, a bit axial location, and a bit cone angle.

16. The machine-readable media of claim 8, wherein the program code to adjust the drilling parameter comprises instructions to adjust a rate of lateral penetration of the drill bit.

17. The method of claim 12, wherein adjusting the drilling parameter comprises adjusting a rate of lateral penetration of the drill bit.

* * * * *